US011358820B2

(12) United States Patent
Clayburn et al.

(10) Patent No.: US 11,358,820 B2
(45) Date of Patent: Jun. 14, 2022

(54) MEDIA BIN SENSORS

(71) Applicant: Hewlett-Packard Development Company, L.P., Spring, TX (US)

(72) Inventors: Jody L Clayburn, Vancouver, WA (US); Arthur H Barnes, Vancouver, WA (US); Francisco Javier Gomez Maurer, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 188 days.

(21) Appl. No.: 16/606,609

(22) PCT Filed: Apr. 21, 2017

(86) PCT No.: PCT/US2017/028970
§ 371 (c)(1),
(2) Date: Oct. 18, 2019

(87) PCT Pub. No.: WO2018/194683
PCT Pub. Date: Oct. 25, 2018

(65) Prior Publication Data

US 2020/0055688 A1 Feb. 20, 2020

(51) Int. Cl.
*B65H 43/08* (2006.01)
*B65H 31/10* (2006.01)
(Continued)

(52) U.S. Cl.
CPC ..... *B65H 31/10* (2013.01); *B65H 31/24* (2013.01); *B65H 7/14* (2013.01); *B65H 43/08* (2013.01);
(Continued)

(58) Field of Classification Search
CPC ..... B65H 7/14; B65H 43/08; B65H 43/06; B65H 31/10; B65H 31/24; B65H 2511/22;
(Continued)

(56) References Cited

U.S. PATENT DOCUMENTS 6,791,100 B2 9/2004 Dye
6,960,777 B2 * 11/2005 Soar ..... B41J 11/009 250/559.11
(Continued)

FOREIGN PATENT DOCUMENTS

CN 1724266 1/2006
CN 104834016 8/2015
(Continued)

OTHER PUBLICATIONS

Epic take-apart: HP Color LaserJet 2600n, 2008, < http://www.evilmadscientist.com/—39 pages.

*Primary Examiner* — Luis A Gonzalez
(74) *Attorney, Agent, or Firm* — Mannava & Kang

(57) ABSTRACT

A printing apparatus includes a media bin and a sensor, directed toward the media bin, having a first emitter and a receiver. The printing apparatus further includes a second emitter to emit photons toward the optical sensor, and a controller. The controller determines presence of a print media on the media bin based on a count of photons received from a source other than the first emitter, including the second emitter.

13 Claims, 9 Drawing Sheets

(51) Int. Cl.
*B65H 31/24* (2006.01)
*B65H 7/14* (2006.01)

(52) U.S. Cl.
CPC .... *B65H 2511/22* (2013.01); *B65H 2511/515* (2013.01); *B65H 2553/414* (2013.01)

(58) Field of Classification Search
CPC ..... B65H 2511/51; B65H 2511/515; B65H 2553/414; B65H 2553/412; B41J 11/0095; G03G 2215/00611; G03G 2215/00616; G03G 2215/0062; G03G 2215/00725; G03G 2215/00911; G03G 2215/00751
See application file for complete search history.

(56) References Cited

U.S. PATENT DOCUMENTS

| | | | | |
|---|---|---|---|---|
| 7,073,789 | B2 * | 7/2006 | Suzuki | B65H 7/14 271/145 |
| 7,980,553 | B2 | 7/2011 | Haflinger et al. | |
| 8,469,482 | B2 * | 6/2013 | Pawlik | B41J 11/009 347/19 |
| 8,653,440 | B2 | 2/2014 | Parks et al. | |
| 9,254,980 | B2 | 2/2016 | Ahne et al. | |
| 9,332,145 | B2 | 5/2016 | Lewis et al. | |
| 2003/0025092 | A1 | 2/2003 | Barnes | |
| 2004/0007806 | A1 | 11/2004 | Suzuki | |
| 2005/0219305 | A1 | 10/2005 | Kikuchi et al. | |
| 2007/0076074 | A1 | 4/2007 | Zhang et al. | |
| 2007/0090583 | A1 | 4/2007 | Brown et al. | |
| 2011/0292476 | A1 * | 12/2011 | Yomogida | H04N 1/00694 358/498 |
| 2012/0056026 | A1 | 3/2012 | Matlin et al. | |
| 2015/0102548 | A1 | 4/2015 | Balili et al. | |

FOREIGN PATENT DOCUMENTS

| | | |
|---|---|---|
| EP | 1253097 | 11/2002 |
| JP | 55157253 | 11/1980 |
| JP | 62156544 | 7/1987 |
| JP | 07311160 | 11/1995 |
| JP | 09113230 | 5/1997 |
| JP | 2003306255 | 10/2003 |
| JP | 2005156380 | 6/2005 |
| JP | 2005529313 | 9/2005 |
| JP | 2011126646 | 6/2011 |
| JP | 2012123003 | 6/2012 |
| WO | WO-2015187125 | 12/2015 |

* cited by examiner

MEDIA BIN SENSORS

BACKGROUND

Printing and copying devices are used to produce copies of documents. For example, a printing and copying device may obtain media, such as paper, from a media bin and produce an image and/or text onto the paper. The paper with the printed image and/or text may be provided to an output tray of the printing and copying device so that a user may obtain the printed paper from a common output area. Multiple printed sheets may be produced and provided to the output tray for retrieval by a user.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1A:
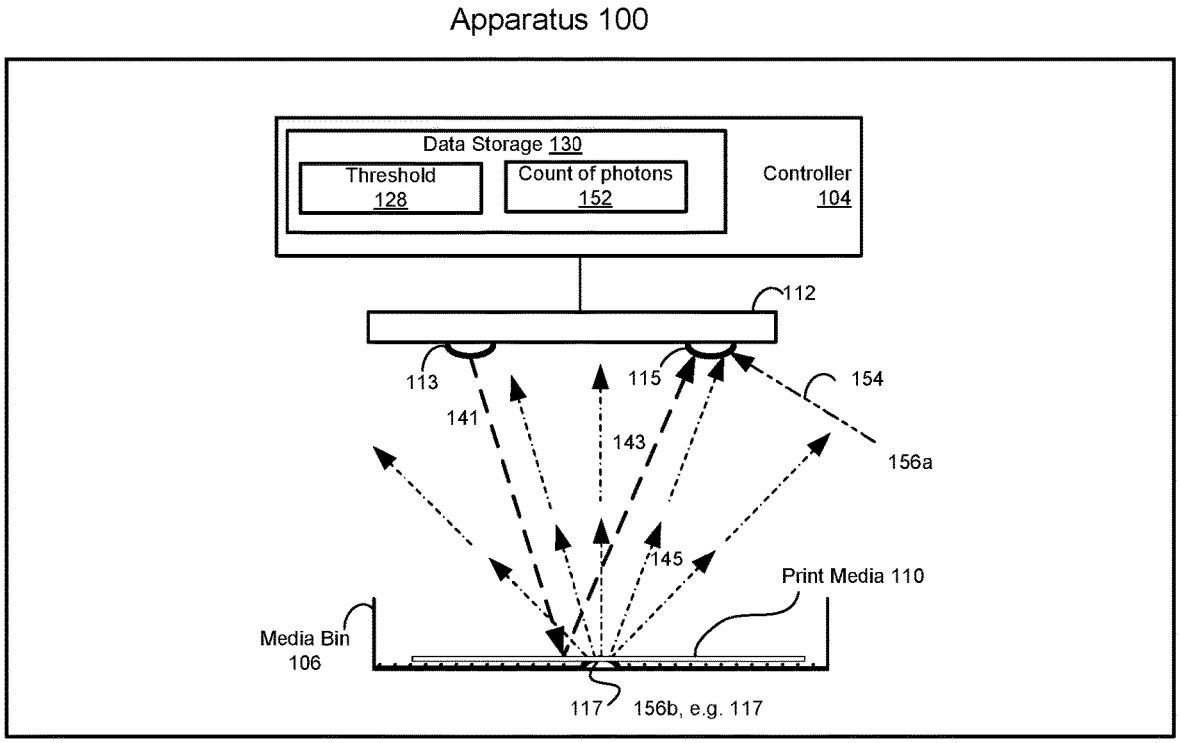
FIG. 1A, FIG. 1B and FIG. 1C show block diagrams of an example printing apparatus including a media bin.

As used herein, the terms "a" and "an" are intended to denote at least one of a particular element, the term "includes" means includes but not limited to, the term "including" means including but not limited to, and the term "based on" means based at least in part on.

A printing apparatus, according to an example of the present disclosure, detects the presence of a print media on a media bin or when the media bin is empty using a time-of-flight sensor, hereinafter sensor. In an example, the sensor may be an optical transceiver, i.e. has a first emitter and a receiver. A second emitter may transmit photons toward the sensor. In an example, the second emitter may be an infrared led. In an example, the second emitter may be placed on the media bin facing the sensor. When print media is on the media bin, the print media may diffuse photons from the second emitter reducing the count of photons received at the receiver of the sensor. The printing apparatus may detect the presence of the print media by comparing a count of photons received at the sensor when a sheet of the print media is on the media bin and a count of photons received at the sensor when the print media is not on the media bin.

The photons received by the receiver of the sensor for any source other than the first emitter of the sensor may be described as noise or ambient noise. The photons emitted by the second emitter and received by the receiver of the sensor may be described as induced noise. The photons emitted by the first emitter and received by the receiver of the sensor may be described as a signal. The photons emitted by sources other than the first emitter and the second emitter may be described as atmospheric noise, such as photons received from lighting in the environment housing the printing apparatus.

In an example, the sensor may not be able to differentiate between the induced noise and the atmospheric noise. In an example, the sensor may differentiate between the signal and the noise, but may not be able to differentiate between induced noise and atmospheric noise. In other words, the sensor may identify the photons received from the first emitter of the sensor and identify any other photons received as noise, including induced noise and atmospheric noise. The origin of noise or ambient noise may be described as "a source other than the first emitter," "a source other than the first emitter of the sensor," or "a source other than the first sensor." The source other than the first emitter may include the second emitter. Also, the print media may be one sheet of paper or more than one sheet of paper.

In an example, the sensor may determine the count of the noise, such as a count of the photons emitted by a source other than the first emitter and received at the receiver of the sensor. The count of the noise may be reduced when the print media is on the media bin. In an example, the threshold may be 98% to 102% of the count of noise received at the sensor when the media bin has print media.

In an example, the sensor may be an optical sensor. In an example, the emitter directed toward the sensor may be an optical emitter. Also, the sensor may be arranged in a media bin assembly to be directed toward the media bin and the emitter may be arranged in a media bin assembly to be directed toward the sensor. For example, the sensor may emit photons toward the media bin. The sensor measures the distance between itself and a surface facing the sensor, for example, by measuring the time it takes for light to travel from the transmitter of the sensor to the receiver of the sensor. In an example, the transmitter and receiver may be co-located, such as located on a same plane and/or part of a single sensor. According to an example of the present disclosure, when the measured distance is within a threshold, the sensor may use the second transmitter facing the sensor to determine the count of photons received per unit time at the receiver of the sensor. When the count of the photons received per unit time is within a threshold, the printing apparatus may determine the presence of print media on the media bin.

In an example, the media bin may be a receptacle for holding print media which may include a single sheet or multiple sheets of paper or other types of print media. In an example, the media bin may be a tray for collecting the print media after the printing apparatus produces text and/or images on the print media, such as an output media bin. In an example, the media bin may hold different sizes of the print media. In an example, the media bin may hold print media with a specific gram per square meter thickness (GSM). In another example, the media bin may hold print media of different types such as plain paper, glossy paper, photo paper, etc. In another example, the media bin may be an input media bin that holds the print media prior to printing.

In an example, the sensor may be an optical time-of-flight sensor that determines the distance between the sensor and the surface facing the sensor, such as the opposing surface of the media bin if the media bin is empty or the surface of print media on the media bin. The distance is measured based on the time it takes for photons transmitted from the sensor to be reflected back to the sensor from the surface facing the sensor. The sensor may be an analog time-of-flight sensor or a digital time-of-flight sensor. In addition to measuring distance based on time-of-flight of the photons, the sensor may also measure the number of received photons per unit time. In an example, the received photons at the sensor include the photons reflected from the surface facing the sensor. In another example, the sensor may measure the number of photons reflected per unit time from the surface, such as number of photons transmitted by the sensor and number of those photons received by the sensor. The sensor may use a particular wavelength of light or may transmit photons in a particular pattern to differentiate between photons transmitted and photons which were not transmitted by the sensor. In an example, the translucency value may be the number of photons transmitted by a source other than the sensor, through the print media, detected at the sensor per unit time. The translucency value when no print media is present may be the number of photons transmitted by the source other than the sensor, detected at the sensor per unit time. In an example, the sensor may include an ambient light detector. In an example, the translucency value may be measured using the ambient light detector. The sensor may include an optical transmitter and an optical receiver.

A technical problem associated with the sensor is how to determine whether the media bin has print media on the media bin when the thickness of print media on the media bin is less than a threshold associated with a minimum thickness that can accurately be determined by the distance measurement of the sensor. For example, if the minimum thickness of print media on the media bin the sensor can accurately measure based on the distance measurement is five millimeters (mm), and a single sheet of 80 GSM paper is 0.1 mm (typically ~0.10 mm), the single sheet of 80 GSM paper may not be able to be detected by the distance measurement of the sensor. For example, if the printing apparatus determines the distance measured by the sensor is within a threshold associated with the 5 mm, the printing apparatus may initially consider the media bin to be empty if the thickness of the print media on the media bin is less than 5 mm. The printing apparatus described in further detail below according to examples of the present disclosure is able to accurately determine the presence of at least a single sheet or multiple sheets of paper on the media bin based on the count of photons of noise per unit time. Accordingly, if a single sheet of paper or multiple sheets of paper having a thickness below a minimum measurable thickness based on a distance measurement is on the media bin, the printing apparatus may be able to detect the single sheet or multiple sheets of papers on the media bin. In another example, the printing apparatus may not be able to detect multiple sheets of paper having a translucency value outside a calibration threshold as discussed below.

Furthermore, the printing apparatus may be able to control operations of the printing apparatus, which are further described below, based on the detected print media on the media bin. Another technical problem is associated with the use of contact or mechanical sensors to determine presence of print media on a media bin. The contact or mechanical sensors can damage print media. Also, contact or mechanical sensors are prone to damage when print media is returned to the media bin, such as mechanical flags of the contact or mechanical sensors breaking when print media is returned or put-back. The printing apparatus with the time-of-flight sensor described in the examples below is able to determine the presence of the print media without using contact sensors or mechanical sensors. Also, the sensors in the printing apparatus in the example described below are not damaged when print media is removed from the media bin and placed back on the media bin. Furthermore, the printing apparatus is able to determine when print media is removed from the media bin and placed back on the media bin.

With reference to FIG. 1A, there is shown a block diagram of a printing apparatus 100, referred to hereinafter as apparatus 100, according to an example of the present disclosure. The apparatus 100 may include a media bin 106 for holding print media 110. The apparatus 100 may include a controller 104 for controlling a sensor 112. The sensor 112 may be directed toward the media bin 106. For example, the first emitter 113 of the sensor 112 may emit photons toward the media bin 106, shown as transmitted photons 141, and receive reflected photons 143 at the receiver 115 of the sensor 112, which are further discussed below. In an example, the photons transmitted by the first emitter 113 that are received by the sensor 112 may be described as the signal. As shown in FIG. 1A, the media bin 106 holds the print media 110, and the transmitted photons 141 are directed toward a surface 120, such as the surface of the print media 110 on the media bin 106. In other examples described below, the surface 120 may be an opposing surface 108 of the media bin 106, when the media bin 106 is empty. The opposing surface 108 faces the sensor 112 and may reflect the transmitted photons 141 if the media bin 106 is empty, such as discussed below. The opposing surface 108 is shown with ridges to distinguish the opposing surface 108 from other surfaces, but the opposing surface 108 may be flat.

The apparatus 100 may include a second emitter 117. In an example the second emitter 117 may be on the media bin 106, directed toward the sensor 112. In another example, the second emitter 117 may be below a surface of the media bin 106, directed toward the sensor 112. For example, the second emitter 117 may emit photons toward the sensor 112, shown as transmitted photons 145, received at the receiver 115 of the sensor 112. The apparatus 100 may receive photons from a source 156*a*, 156*b*, etc., other than the first emitter 113. In an example, the source 156*a* may be photons from lighting in the environment which may be described as atmospheric noise. In an example the source 156*a* may be photons from the second emitter 117 received at the receiver 115 of the sensor 112 which may be described as induced noise.

In order to determine presence of print media 110, the controller 104 may determine whether a count of photons 152 measured by the sensor 112 is within a threshold 128. For example, the threshold 128 is a count of photons for a single sheet of print media. For example, the threshold may be determined based on translucency of a single standard sheet of blank paper. Standard paper for example is 80 GSM. For example, the 80 GSM diffuses some of the photons emitted by the second emitter 117, thereby reducing the number of photons received at the sensor 112. The threshold 128 may be based on a maximum translucency and a minimum translucency for a single sheet, as is further discussed below with respect to FIG. 3E. Accordingly, the threshold 128 may be a range. If the count of photons falls within the range, such as within the threshold 128, then the controller 104 determines print media is present on the media bin 106. In an example, the threshold 128 may be 98% to 102% of a count of photons when print media of a predetermined thickness (e.g., single sheet of 80 GSM paper) is present on the media bin 106.

In an example, the media bin 106 may hold the print media 110 before the apparatus 100 prints images and/or text on the print media 110. In an example, the media bin 106 may hold the print media 110 after the apparatus 100 prints images and/or text on the print media 110. In an example, the media bin 106 may hold a stack (multiple sheets) of print media 110.

In an example, the sensor 112 may be a time-of-flight sensor. In an example, the sensor 112 may determine the distance to the surface 120 using a laser transmitter and time-of-flight of the laser received at a laser receiver on the sensor 112 after reflection from the surface 120. In an example, the sensor 112 may determine a distance using the number of photons transmitted by sensor 112 and the number of photons received by sensor 112 integrated over a period of time. In an example, the sensor 112 may determine a distance using an outgoing beam transmitted by the transmitter 113 of photons modulated with a radio frequency carrier and then measuring the phase shift of that carrier when received by the receiver 115 of the sensor 112 after reflection from the surface 120. In an example, the sensor 112 may determine a distance 114 using a range gated imager that opens and closes at the same rate as the photons set out. In the range gated imager, a part of the returning photons is blocked according to time of arrival. Thus, the number of photons received relates to the distance traveled by the photons. The distance traveled can be calculated using the formula, $z=R\ (S_2-S_1)/2(S_1+S_2)+R/2$, where R is the sensor range, determined by the round trip of the light pulse, $S_1$ is the amount of light pulse that is received, and $S_2$ is the amount of the light pulse that is blocked. In an example, the sensor 112 may measure the direct time-of-flight for a single laser pulse to leave the sensor 112 and reflect back onto a focal plane array of the sensor 112. The sensor 112 may use InGaAs avalanche photo diode or photodetector arrays capable of imaging laser pulse in the 980 to 1600 nm wavelengths. In an example, sensor 112 may include an illumination unit for illuminating the scene, an optical unit to gather the reflected light, an image sensor where a pixel measures the time the light has taken to travel from the illumination unit to the object and back to the focal plane array and driver electronics. In an example, the illumination unit may include a laser diode or an infrared led. In an example, the optical unit of sensor 112 may include an optical band-pass filter to pass light with the same wavelength as the illumination unit to suppress non-pertinent light and reduce noise of the light received. In an example, sensor 112 may include an ambient light sensor to determine a signal-to-noise ratio, between the light received by the sensor 112 which was transmitted from sensor 112 and the light received by the sensor 112 which is ambient light.

In an example, the controller 104 may include data storage 130. The data storage 130 may store at least one of the count of photons 152 and the threshold 128. The controller 104 is further shown and described with respect to FIG. 5.

Figure 1B:
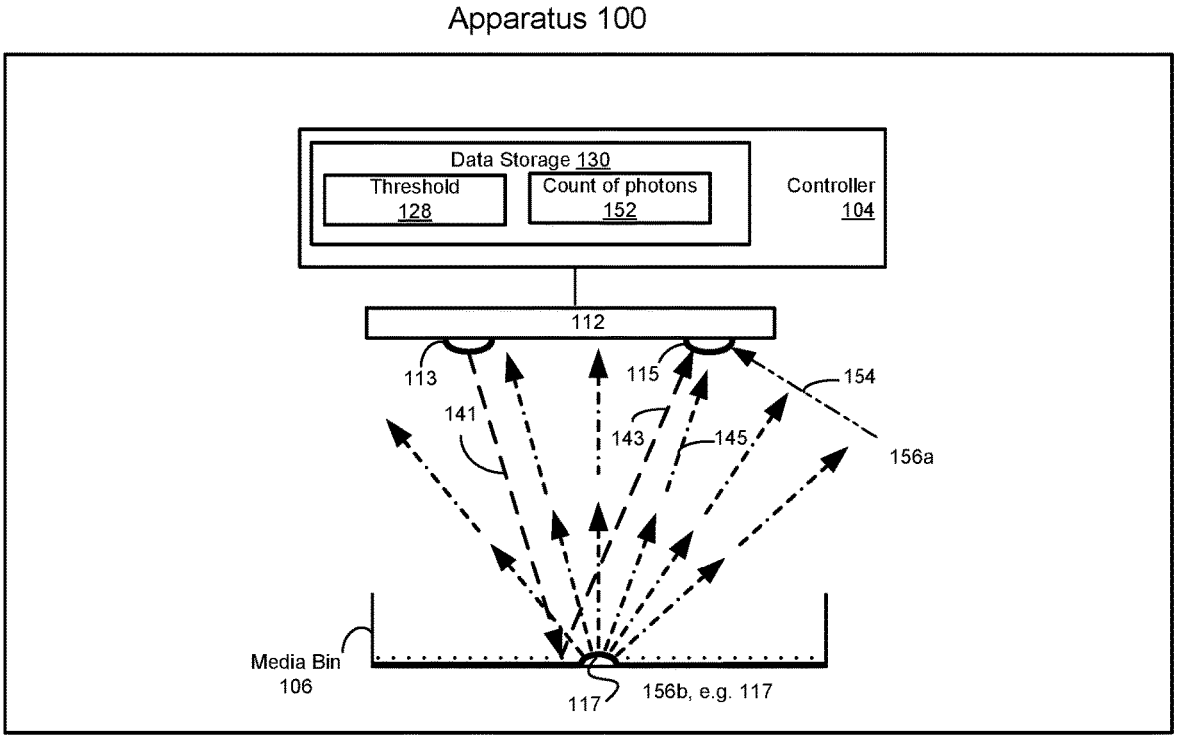

With reference to FIG. 1B, the figure shows an example instance whereby the media bin 106 has no print media 110. This figure thus shows when no photons are diffused by print media on the media bin 106.

Figure 1C:
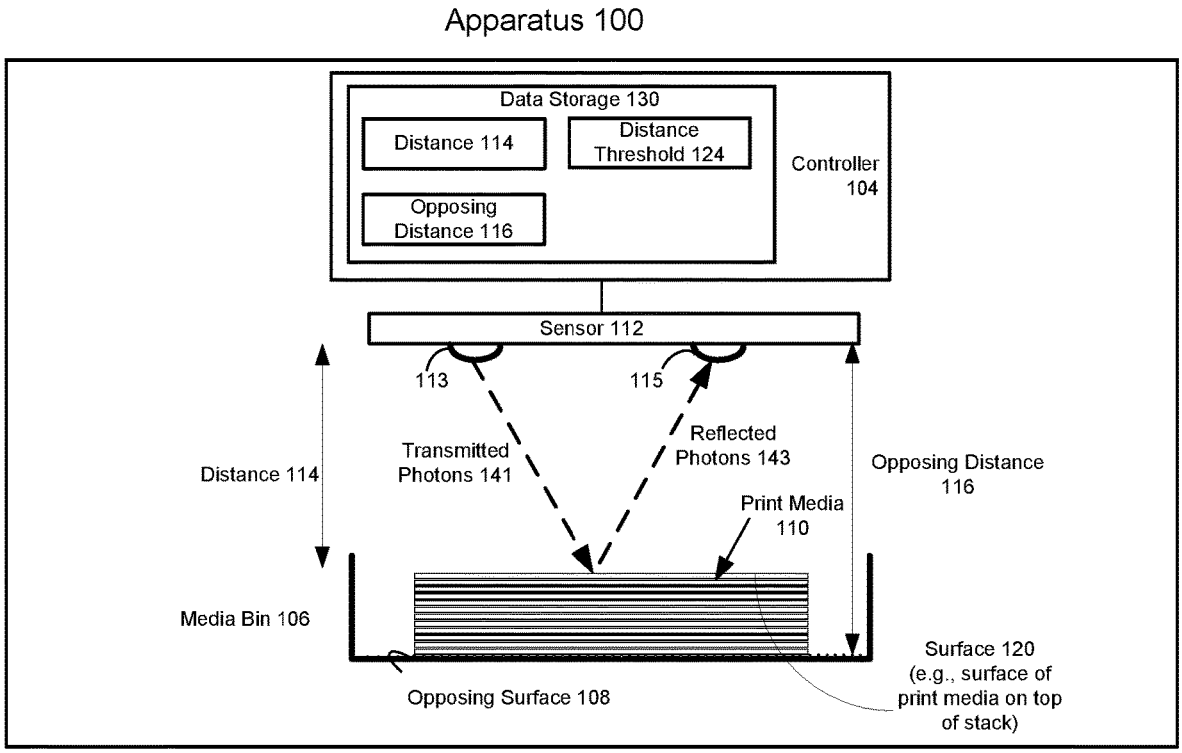

In an example, height of print media 110 to determine whether print media is present on the media bin. For example, distances 114 and 116 shown in FIG. 1C may be used to determine whether print media is present on the media bin. If the media bin is determined to be empty based on the distance measurement, the count of photons 152, discussed above may be used to confirm whether the bin is empty. With reference to FIG. 1C, the figure shows an example instance whereby multiple sheets of print media 110 are on the media bin 106, and the distance 114 may be measured to detect the print media 110. In an example, the controller 104 may determine the distance 114 based on the time-of-flight for photons transmitted from the sensor 112 and received back at the sensor 112 after reflection from the surface 120. For example, the reflected photons 143 are photons of the transmitted photons 141 that are reflected back to the sensor 112. The controller 104 may determine whether the distance 114 measured between the sensor 112 and the surface 120 is within a distance threshold 124. In an example, the distance threshold 124 may be based on an opposing distance 116 between the sensor 112 and the opposing surface 108. For example, the distance threshold may be 98% to 102% of the opposing distance 116. When the distance 114 is within the distance threshold 124, the controller 104 may consider the media bin 106 empty. In order to confirm whether the media bin 106 is empty, the controller 104 may determine if the count of photons 154 is within the threshold 128.

Figure 2A:
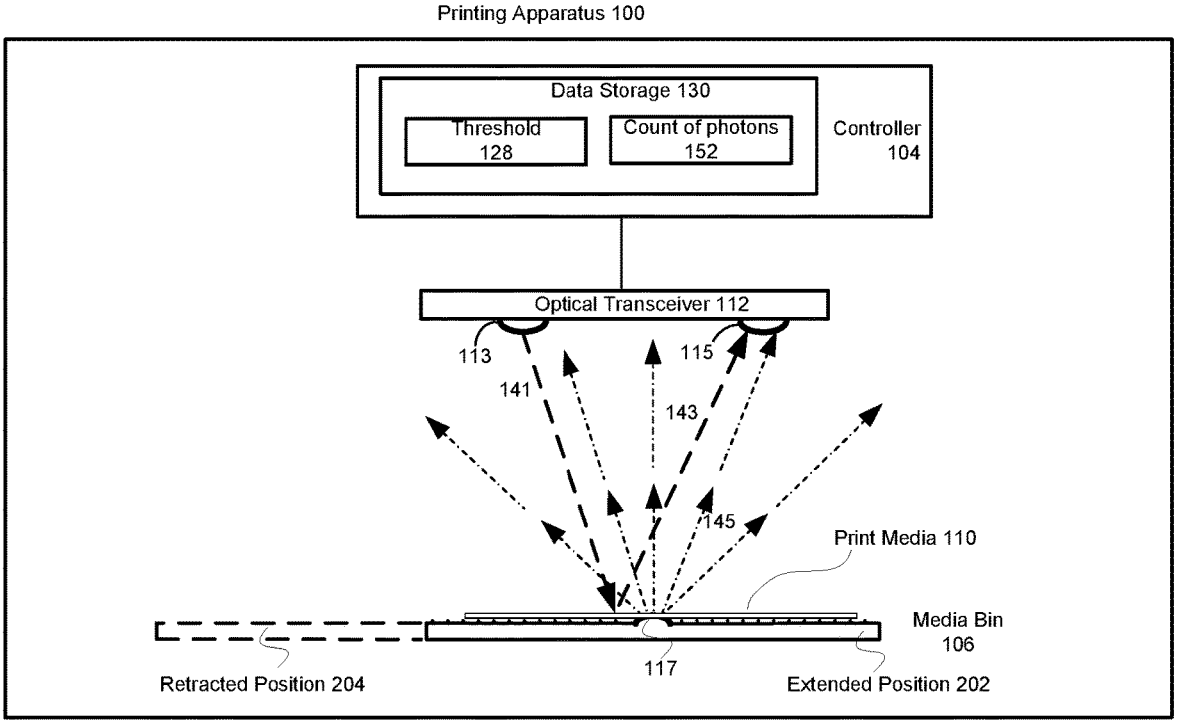
FIG. 2A, and FIG. 2B show block diagrams of an example printing apparatus including a translatable media bin.
Figure 2B:
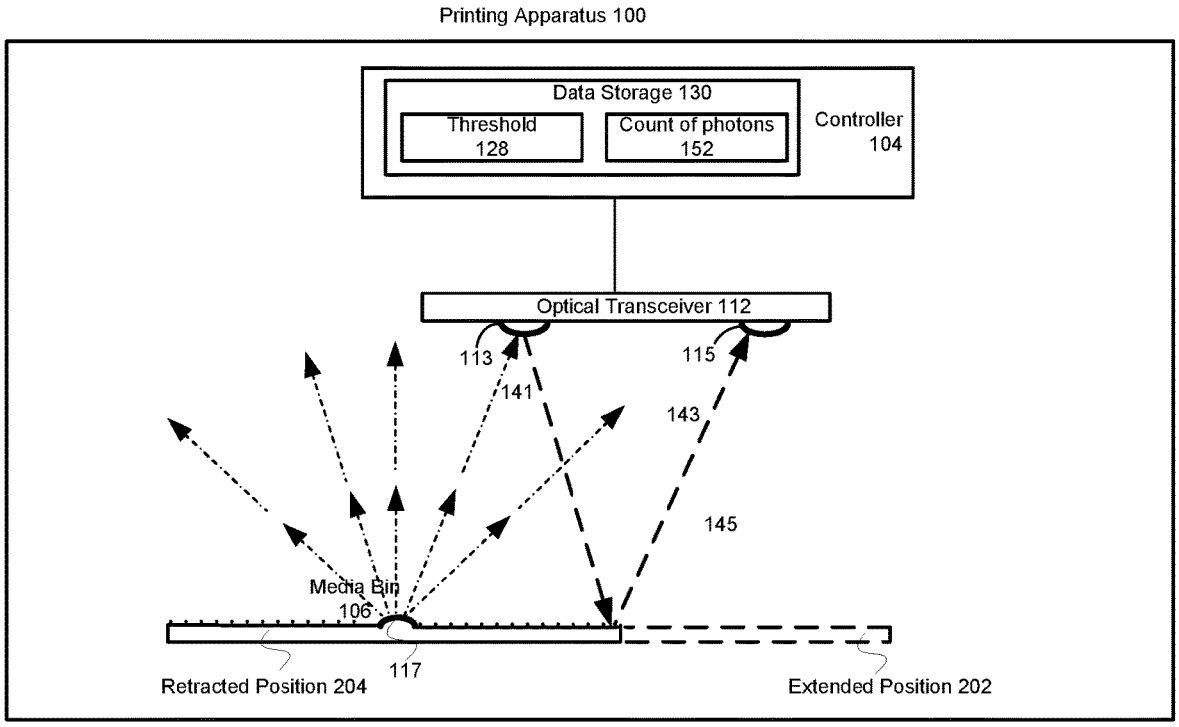

With reference to FIG. 2A and FIG. 2B, the media bin 106 may be laterally translatable between an extended position 202 and a retracted position 202. For example, FIG. 2A shows the media bin 106 in the extended position 202. The controller 104 may extend the media bin 106 to the extended position 202 when print media 110 is printed to the media bin 106. FIG. 2B shows the media bin 106 in the retracted position 204. The controller 104 may retract the media bin 106 to the retracted position 204 when print media 110 is removed from the media bin 106. The media bin 106 may be a finisher tray and may be laterally translated between the extended position 202 and retraced position 204 based on whether a translucency value 192 of print media 110 measured by the sensor 112 is within the translucency threshold 194. In an example, the print media 110 may be picked up and replaced on the media bin 106, preventing the media bin 106 from being retracted to the retracted position 204. In an example, the controller 104 may communicate an alert when the media bin 106 is not empty, such as when the media bin is a finisher tray in the extended position 202. In another example, the controller 104 may communicate an alert when the media bin 106 is empty, such as when the media bin 106 is an input bin.

Figure 2C:
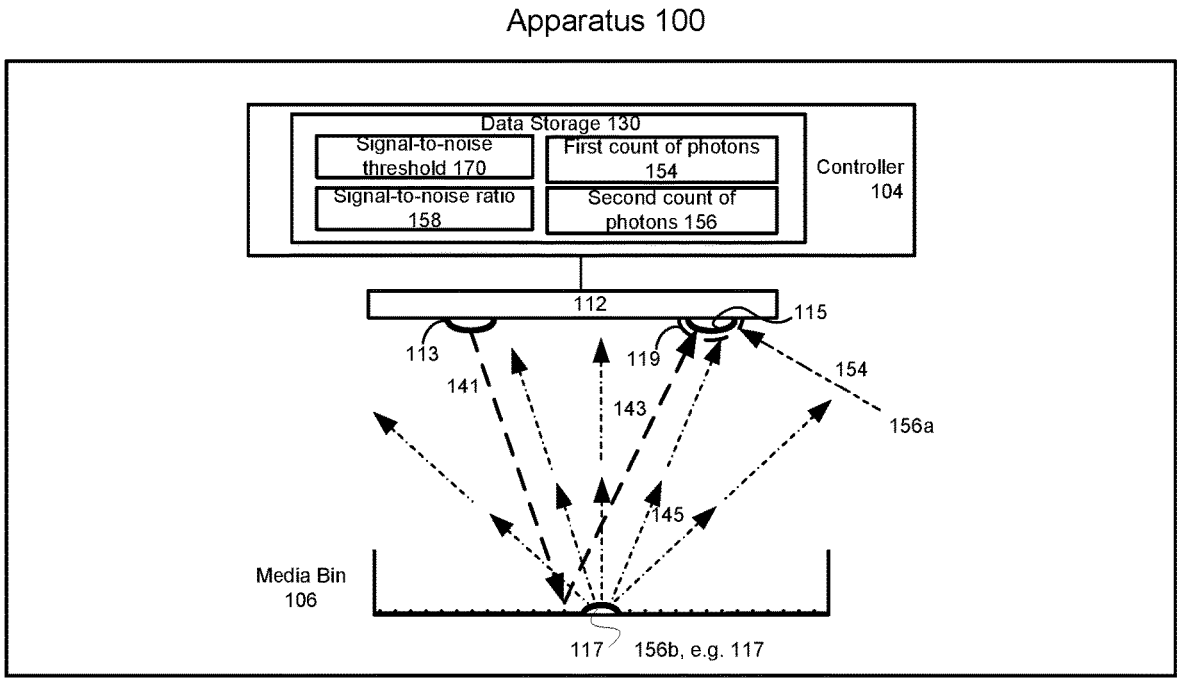
FIG. 2C and FIG. 2D show block diagrams of an example printing apparatus including a filter for a sensor.

With reference to FIG. 2C, the figure shows an example instance whereby the receiver 115 of the sensor 112 may include a filter 119. Examples of the filter 119 may include a range gated imager that opens and closes at the same rate as the photons set out. For the range gated imager, a part of the returning photons is blocked according to time of arrival. In another example, the filter 119 filters photons based on optical wavelength. For example, the filter 119 may pass photons 143 which are a particular wavelength and reject photons 145 and 154 that have a wavelength different from photons 143.

In an example, the filter 119 may remove photons from sources other than the first emitter 113. In another example, the filter 119 may remove photons from the first emitter 113. In another example, the controller 104 may calculate a signal-to-noise ratio 158 of photons, where the signal is a first count of photons 154 received from the first emitter 113 and noise is a second count of photons 157 from the source 156 received from the source 156*a*, 156*b*, etc., other than the second emitter 117. In another example, the source 156*b* may include the second emitter 117. When the signal-to-noise ratio 158 is outside the signal-to-noise threshold 170, the controller 104 may determine print media 110 is not present on the media bin 106, as shown in the figure. In another example, when the signal-to-noise ratio 158 is within the signal-to-noise threshold 170, the controller 104 may determine print media 110 is present on the media bin 106. In response to the determination that the print media is not present on the media bin 106, the controller 104 may translate the media bin laterally, i.e. from the extended position 202 to the retracted position 204 or from the retracted position 202 to the extended position 204 as discussed above with reference to FIGS. 2A and 2B. In an example, the controller 104 may determine whether the media bin 106 is empty when the media bin is in the extended position 202. In another example, the controller 104 may determine whether the media bin 106 is empty when the media bin is in the retracted position 204.

Figure 2D:
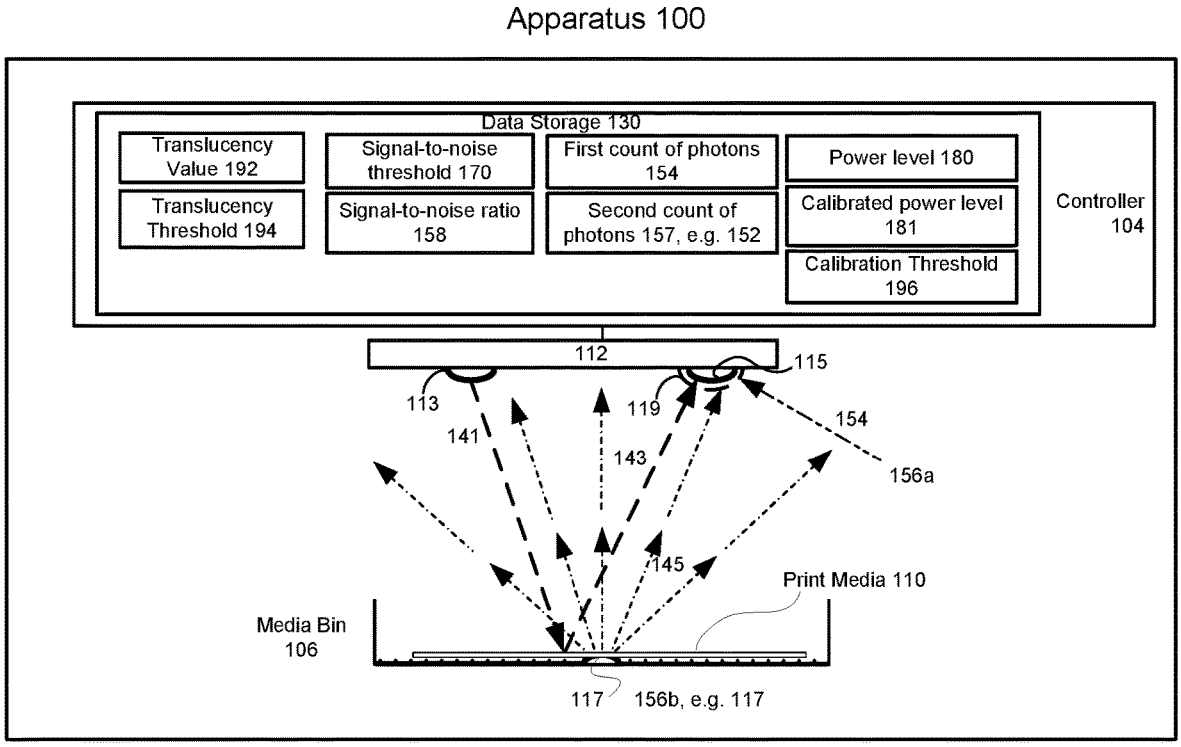

With reference to FIG. 2D, the figure shows an example instance whereby the receiver 115 of the sensor 112 may include the filter 119. In an example, the apparatus 100 may determine a first count of photons received at the receiver 115 of the sensor 112, based on photons received from the first emitter 113 at the receiver 115. In an example, the controller 104 may determine a second count of photons 157 received at the receiver 115 of the sensor 112, based on photons received from any source other than the first emitter 113 at the receiver 115. The controller 104 may determine a signal-to-noise ratio of photons based on the first count of photons and the second count of photons. For example, the signal-to-noise ratio may be represented as the first count of photons/the second count of photons, where the first count of photons and the second count of photons 157 are measured by the sensor 112 for the same unit time.

The sensor 112 may measure a translucency value 192 of an object placed between the receiver 115 of the sensor 112 and the second emitter 117. For example, translucency value of print media 110 may be a count of photons received at the receiver 115 of the sensor 112 form a source other than the first emitter 113 of the sensor 112. In another example, translucency value may be represented based on a count of photons received at the receiver 115 emitted from the second emitter 117, when the source 156*a* is static. In an example, a translucency threshold 194 may be a range of translucency values when print media 110 is present on the media bin 106. For example, the translucency threshold 194 may be 98% to 102% of a translucency value for the number of photons received at the receiver 115 from a source other than the first emitter.

In an example, the controller 104 may calibrate the second emitter 117 to determine the calibrated power level 181 of the second emitter 117, when the apparatus 100 is initialized. In another example, the sensor 112 may perform a calibration to determine the calibrated power level 181 of the second emitter 117, when print media 110 is first placed on the media bin 106.

Figure 3A:
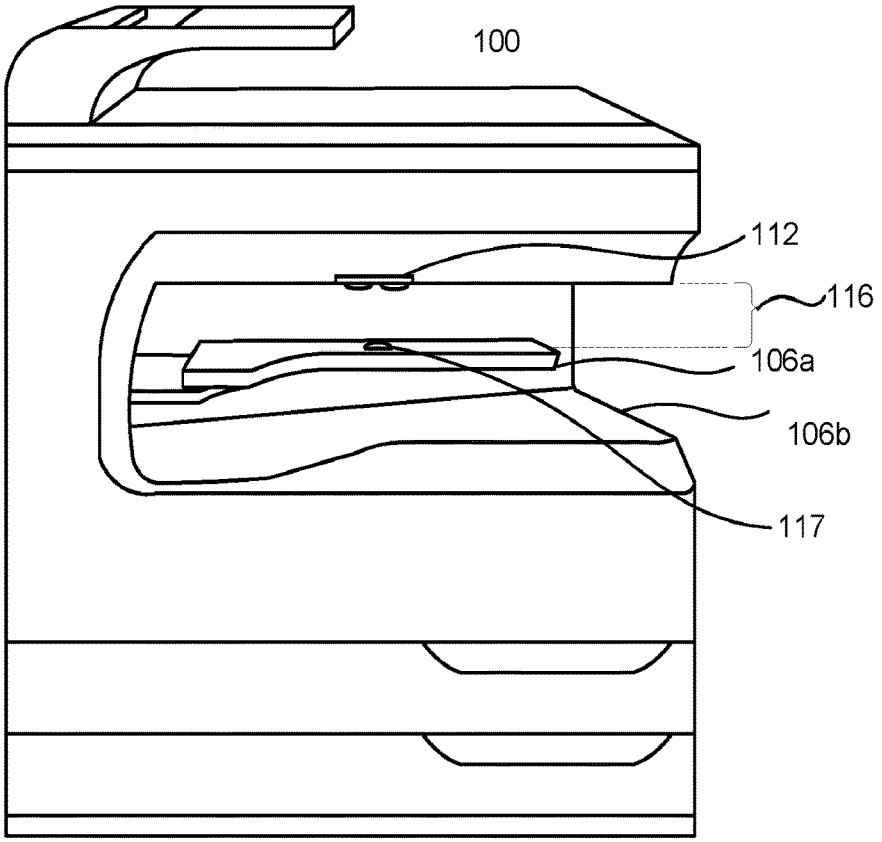
FIG. 3A shows a side view of an example printing apparatus having a translatable media bin.
Figure 3B:
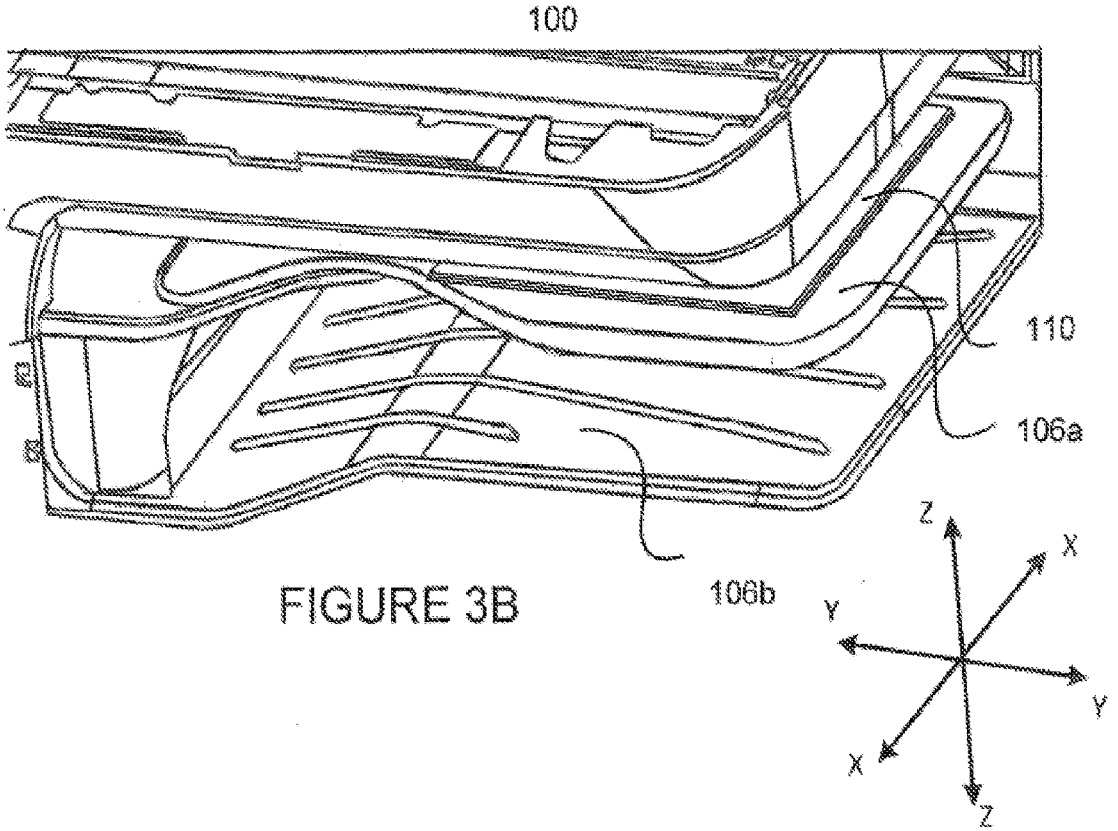
FIG. 3B shows an isometric view of a printing assembly of the printing apparatus shown in FIG. 3A with a translating media bin.
Figure 3C:
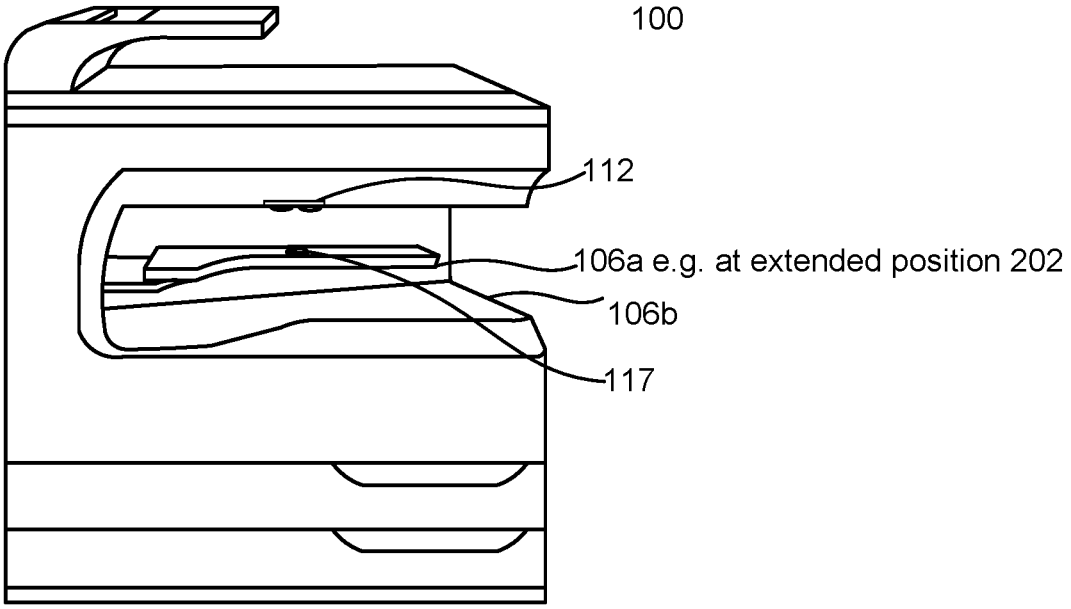
FIG. 3C and FIG. 3D show side views of the printing apparatus with translatable media bin shown in FIG. 3A.
Figure 3D:
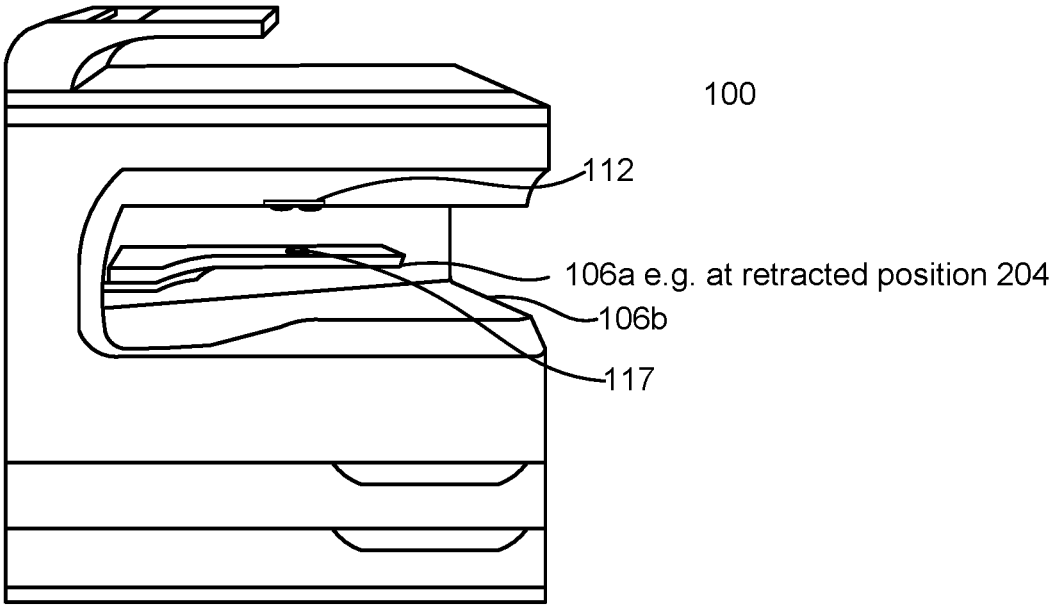

FIG. 3A is a side view of the printing apparatus 100, according to an example. FIG. 3B is an isometric view of the printing apparatus 100, according to an example. FIG. 3A shows two media bins, labeled 106*a* and 106*b*. The media bin 106*a* may be retractable, such as discussed above, to provide easier access to the media bin 106*b*. In an example, as shown in FIGS. 2A, 2B, 3C and 3D the media bin 106*a* may translate from the extended position 202 to the retracted position 204. The media bin 106*a* may be located at the opposing distance 116 from the sensor 112. In an example, with reference to FIG. 3B the media bin 106*a* may translate from the extended position 202 to the retracted position 204 along the Y-Y axis of FIG. 3B. In another example, with reference to FIG. 3B the media bin 106*a* may translate along the X-X axis of FIG. 3B. In another example, with reference to FIG. 3B the media bin 106*a* may translate along the X-X axis of FIG. 3B. In another example, with reference to FIG. 3B the media bin 106*a* may translate along a combination of X-X and Y-Y axis of FIG. 3B. In an example, the media bin 106*a* may hold the print media 110 after printing. In an example, the controller 104 may leave the media bin 106*a* in the extended position 202 when the media bin 106*a* is not empty. In another example, the controller 104 may retract the media bin 106*a* when empty.

Figure 3E:
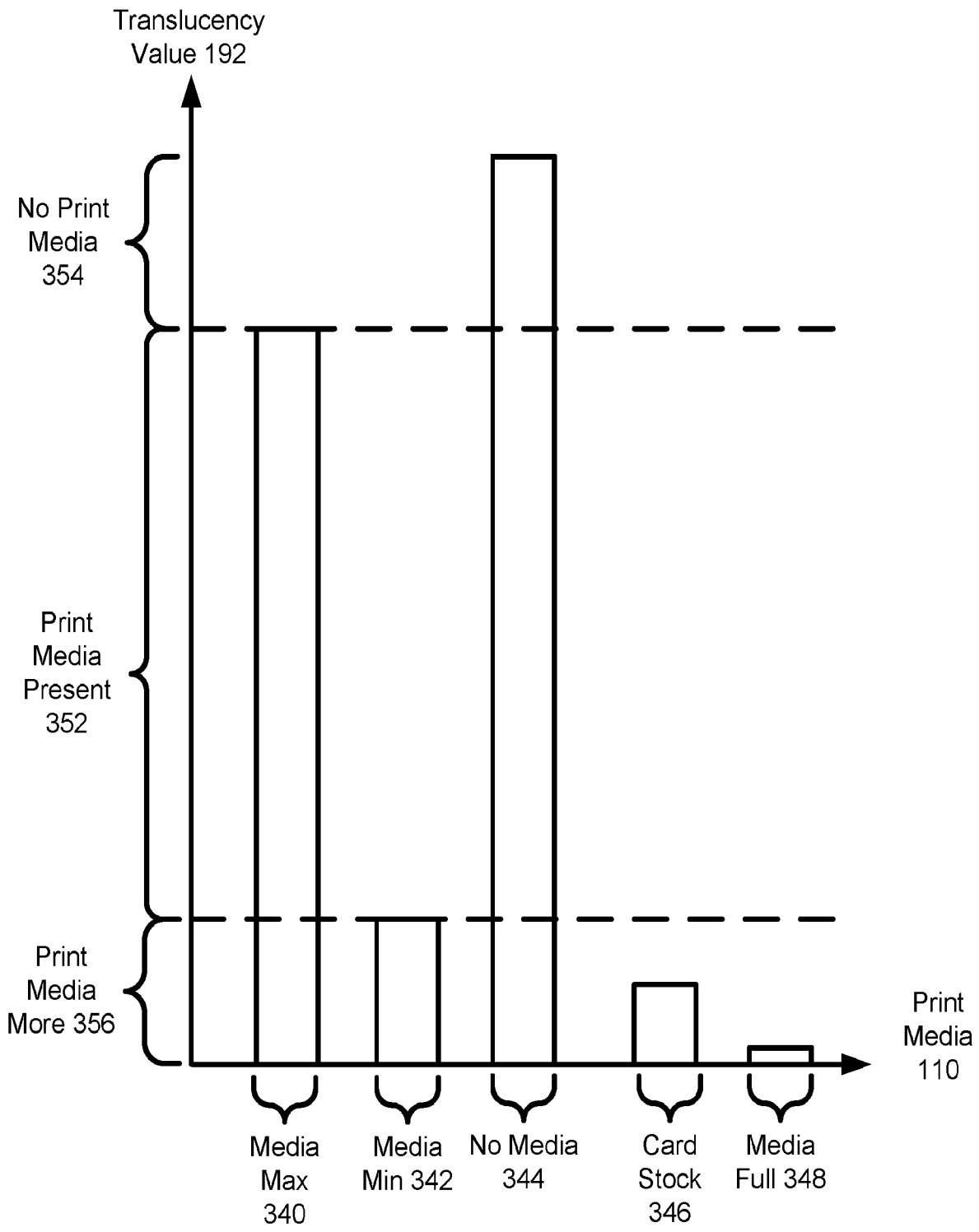
FIG. 3E shows an example histogram of translucency values.

FIG. 3E shows a histogram of translucency values for the print media 110 according to examples of the present disclosure. In an example, the histogram depicts the translucently value 182 of the print media 110, facing the sensor 112. In an example, print media 110 may have different translucency values based on the type such a glossy, plain, photo, etc., the manufacturer, content printed such as text, photos, solid filed areas from power point slides, etc. In an example, the print media 110 on the media bin 106 may have a maximum translucency value 340 and a minimum translucency value 342 as shown in the histogram. In an example, the maximum translucency value 340 may denote a translucency of the print media 110. In an example, the minimum translucency value 342 may denote a translucency value of the print media 110. In an example, the controller 104 may determine presence of media 352 on the media bin 106, when the translucency value 192 measured by the sensor 112 is between the maximum translucency value 340 and the minimum translucency value 342. In another example, the controller 104 may determine absence of media 354 on the media bin 106, when the translucency value 192 measured by the sensor 112 is below the minimum translucency value 342 or above the maximum translucency value 340 of the print media 110.

In an example, when print media 110 is not present, the sensor 112 may measure a translucency value corresponding to no media 344, which may be higher than the maximum translucency value 340 of the print media 110. In an example, the controller 104 may determine presence of media 352 of print media 110. In another example, the controller 104 may determine absence of media 354 of the print media 110 based on the translucency value 192. In another example, the controller 104 may determine presence of a card stock 356 with the translucency value 346 or presence of more than one sheet 356 with the translucency value 348 of the print media 110 based on the translucency value 192 measured by sensor 112. In an example the controller 104, may compare the translucency value 192 to a translucency threshold 194. In an example, translucency threshold 194 may be the range extending from the minimum translucency value 342 to the maximum translucency value 340. When the translucency value 192 measured by the sensor 112 based on the number of photons received from sources 156*a*, 156*b* is within the threshold, the controller 104 may hold the media bin 106 in the extended position 202 as discussed above. In another example, the controller 104 may retract the media bin 106 to the retraced position 202 from the extended position 204 as discussed above, when the translucency value 192 measured by the sensor 112 is outside the threshold.

In an example, print media 110 may be of different types such as plain paper, photo paper, glossy paper, cardstock, paper of different thickness or GSM, etc. Different types of the print media 110 may have different translucency values. In another example, the print media 110 may have different translucency values for the same type of media manufactured by different manufacturers. In another example, print media 110 may have different translucency values, based on the content printed such as text, photos, solid filled areas from power point slides, etc. In an example, the controller 104 may have predetermined media translucency value look up tables for print media 110 of different types.

In an example, the controller 104 may store the media translucency value of the last-printed print media 110. The media translucency value of the last-printed print media 110 may be used to determine whether the last-printed print media 110 has been removed and then replaced in the media bin 106.

Figure 4:
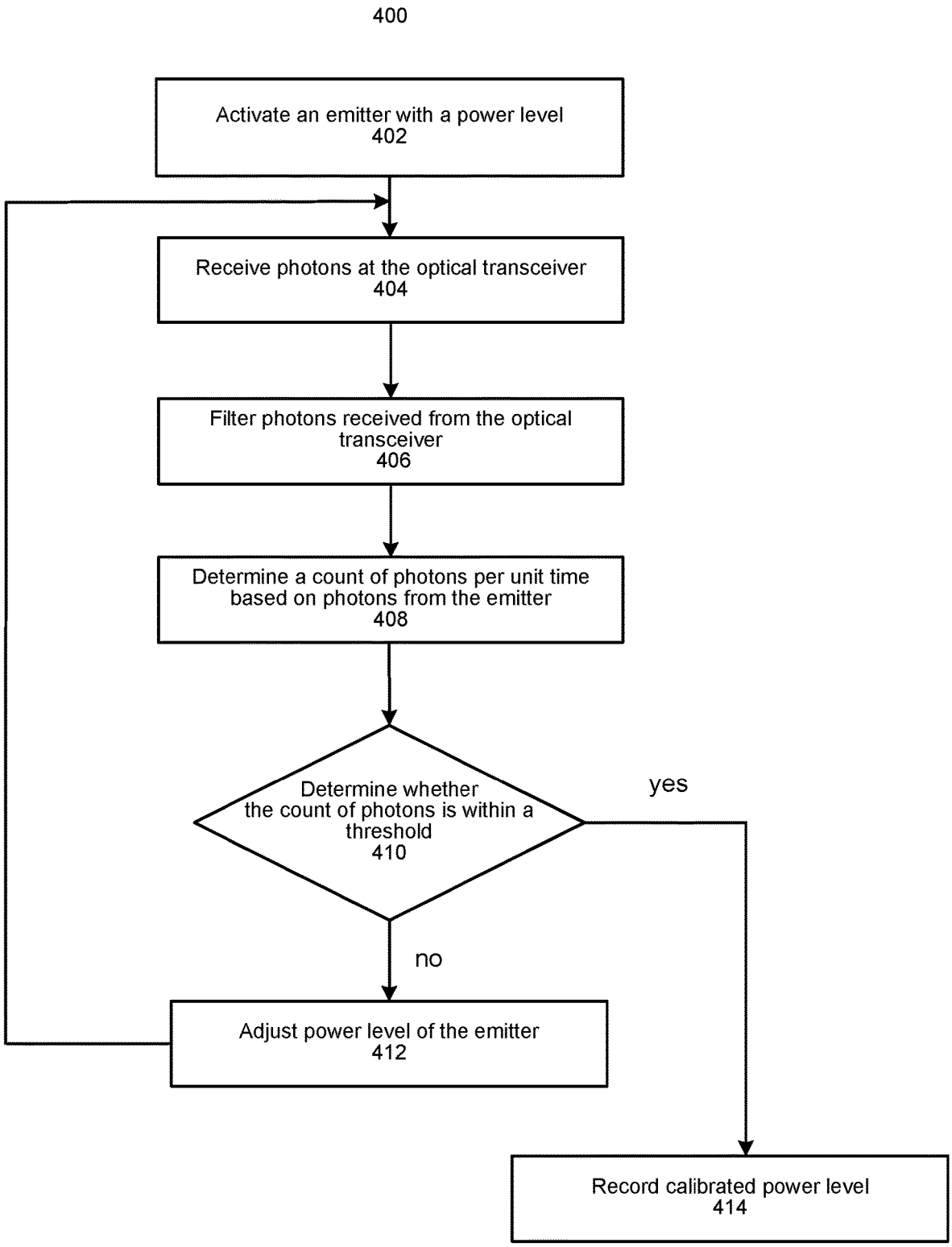
FIG. 4 shows a flow chart of an example method for calibrating a sensor.

FIG. 4 shows an example of a method 400. The method 400 may be performed by the apparatus 100 to calibrate the an emitter, e.g. the second emitter 117, placed below the media bin 106, with a calibrated power level 181 to emit photons that penetrate through print media 110 of certain thickness, such that the photons are received at the sensor 112, e.g. optical transceiver. The sensor 112, e.g. optical transceiver may include the emitter 113, e.g. emitter of the optical transceiver and the receiver 115, e.g. and receiver of the optical transceiver as discussed above. In another example, the method 400 may calibrate the second emitter 117 with the calibrated power level 181 to emit photons when the print media 110 is not present. The method 400 is described by way of example as being performed by the apparatus 100, and may be performed by other apparatus. The method 400 and other methods described herein may be performed by any printing apparatus including at least one processor executing machine readable instructions embodying the method. For example, the apparatus 100 and/or the controller 104 shown in FIG. 2D may store machine readable instructions in the data storage 130 embodying the methods, and a processor in the controller 104 may execute the machine readable instructions. Also, one or more of the steps of the method 400 and steps of other methods described herein may be performed in a different order than shown or substantially simultaneously.

At 402, the apparatus 100 activates an emitter, (e.g. second emitter 117 in FIGS. 2C and 2D) with a power level. For example, with reference to FIG. 2C and FIG. 2D the apparatus 110 activates the second emitter 117 placed on the media bin 106 with a power level 180. In an example, the controller 104 may initialize the power level 180 to a previously calibrated power level from data storage 130.

At 404, the apparatus 100 may use the an optical transceiver (e.g. sensor 112 with reference to FIGS. 2C and 2D) to receive photons including photons emitted by the emitter on the media bin 106 and photons emitted by the optical transceiver and reflected back toward the optical transceiver. For example, with reference to FIGS. 2C and 2D the sensor 112 may receive photons from the first emitter of the sensor 112 and the second emitter 117.

At 406, the apparatus 100 may filter photons received at the optical transceiver which were sent by the optical transceiver to identify photons transmitted by the emitter. For example, with reference to FIGS. 2C and 2D the sensor 112 may filter photons which were transmitted by the transmitter 113 of the sensor 112 as discussed with reference to FIG. 2C to identify photons which were received at the sensor 112 from sources other than the sensor 112. In an example, the sensor 112 may filter all photons which are not of a particular wavelength to filter the required photons.

At 408, the apparatus 100 may determine a count of photons 152 per unit time based on the photons emitted by the emitter which were received at 406. For example, as discussed with reference to FIG. 1A and FIG. 2C the photons emitted by the second emitter 117 with photons from the source 156*a*, i.e. sources other than the first emitter 113 may be used to determine the count of photons per unit time received at optical transceiver 112.

At 410, the apparatus 100 may determine whether the count of photons 152 is within the calibration threshold 196. For example, the calibration threshold 196 may be based on the range of the maximum translucency value 340 and the minimum translucency value 342 for the print media 110 as discussed with reference to FIG. 3C. For example, the calibration threshold 196 is a count of photons received at optical transceiver 112, which exceeds a count of photons when the print media 110 of maximum translucency value is placed in a dark room. In another example, this calibration threshold 196 may be adjusted for atmospheric noise, such as source 156*a*. In an example, the count of photons 152 is within the calibration threshold 196, when a count of photons received at the receiver 115 is 96% to 104% a count of photons received at the sensor 112 when print media 110 of maximum translucency value is placed on the media bin 106, adjusted for atmospheric noise. When the count of photons 152 is within the calibration threshold 196 execution moves to 414. When the count of photons 152 is outside the calibration threshold 196 execution moves to 412. In another example, the threshold 196 may be based on the maximum translucency value and the minimum translucency value of the print media 110.

At 412, the apparatus 100 may adjust the power level and execution moves to 404.

At 414, the apparatus 100 may record the calibrated power level 181 and store the calibrated power level 181 data storage 130. In an example, the calibrated power level 181 may be used to determine presence of print media 110 on the media bin 106.

Figure 5:
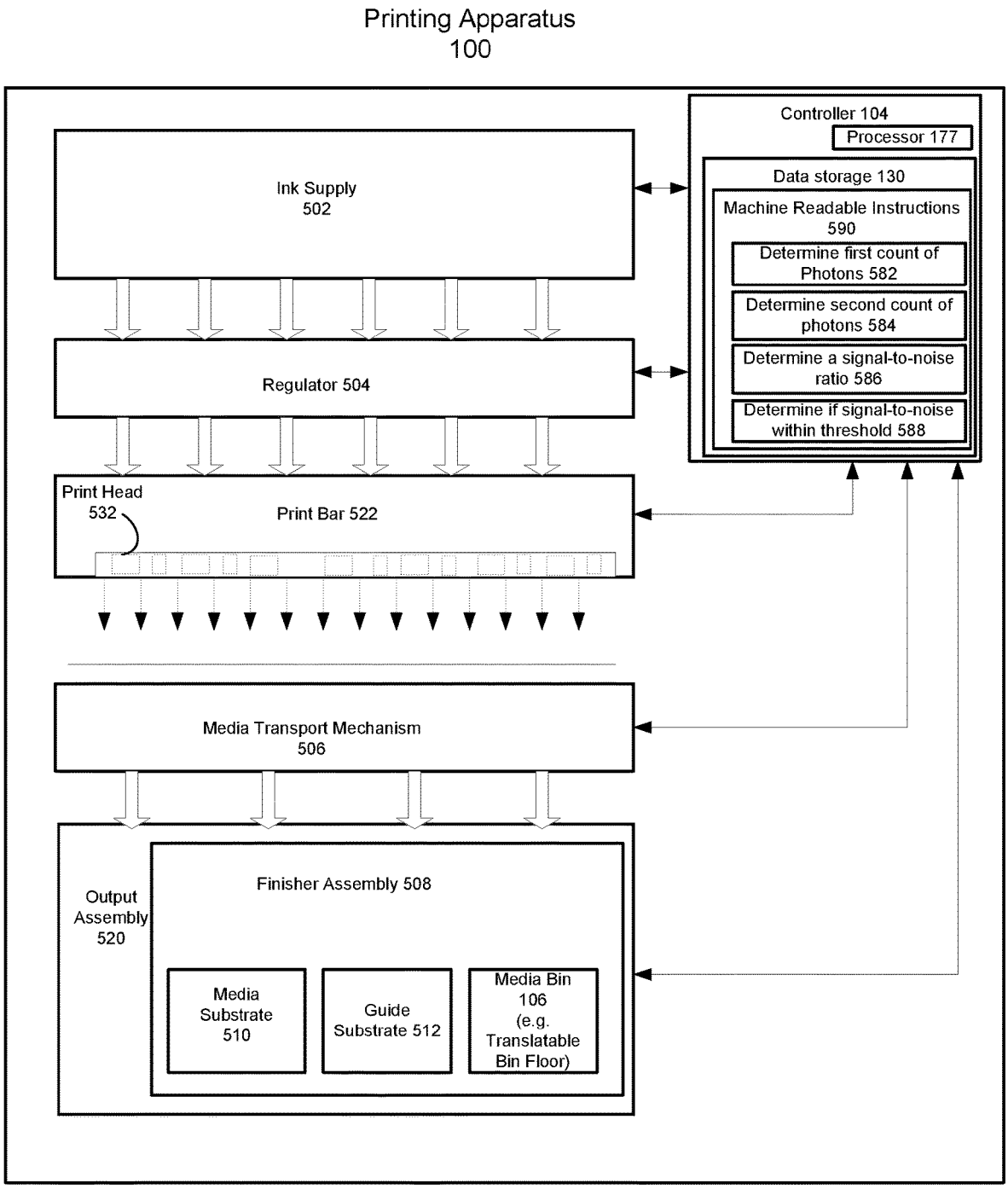
FIG. 5 shows components that may be used in the example printing apparatuses described herein.

FIG. 5 shows a block diagram of the printing apparatus 100 including the media bin 106, according to an example of the present disclosure. The apparatus 100 includes the media bin 106 to receive the print media 110. In an example, the apparatus 100 may receive a number of stacks of the print media 110. In another example, the apparatus 100 may include a print bar 522 that spans the width of the print media 110. In another example, the apparatus 100 may include non-page wide array print heads. The apparatus 100 may further include flow regulators 504 associated with the print bar 522, a media transport mechanism 506, printing fluid or other ejection fluid supplies 502, and the controller 104. Although a 2D printing apparatus is described herein and depicted in the accompanying figures, aspects of the examples described herein may be applied in a 3D printing apparatus.

The controller 104 may represent the machine readable instructions 590, at least a processor 177, at least an associated data storage device 130, and the electronic circuitry and components used to control the operative elements of the apparatus 100 including the firing and the operation of print heads 532, including the print bar 522. The controller 104 is hardware such as an integrated circuit, e.g., a microprocessor. In other examples, the controller 104 may include an application-specific integrated circuit, field programmable gate arrays or other types of integrated circuits designed to perform specific tasks. The controller 104 may include a single controller or multiple controllers. The data storage 130 may include memory and/or other types of volatile or nonvolatile data storage devices. The data storage 130 may include a non-transitory computer readable medium storing machine readable instructions 590 that are executable by the controller 104. In an example, the controller 104 may retrieve the machine readable instructions 590 from the data storage 130 to execute the instructions. At 582, the controller 104 may determine the first count of photons 154 received from the first emitter 113 of the sensor 112, which may be described as signal. At 584, the controller 104 may determine the second count of photons 157, 152 from a source other than the first emitter 113, which may be described as noise. At 586, the controller may determine a signal-to-noise ratio 158, the signal-to-noise ratio based on the first count of photons 154 and the second count of photons 157. At 588, when the signal-to-noise ratio 158 is outside the signal-to-noise threshold 170, the controller 104 may determine print media 110 is not present on the media bin 106. In response to the determination that print media 110 is not present the controller 104 may control the finisher assembly 508 and translate the media bin 106 as described above with respect to FIGS. 3A and 3B.

Further, the controller 104 controls the media transport mechanism 506 used to transport media through the apparatus 100 during printing and to transport the print media 110 to the media bin 106. In an example, the controller 104 may control a number of functions of the media bin 106. In one example, the controller 104 may control a number of functions of the media bin 106 in presenting the print media 110 to a media bin 106 such as a translatable bin floor. Further, the controller 104 controls functions of a finisher assembly 508 to translate a number of stacks of the print media 110 between a number of different locations within the output area.

The media transport mechanism 506 may transport the print media 110 from the media bin (not shown in figure) for feeding paper into the printing apparatus 100 to the output assembly 520 used for collection, registration and/or finishing of the print media 110. In an example, the print media 110 collected on the output assembly 520 includes at least one of the print media 110 having text and/or images produced. In an example, a completed collection of the print media 110 may represent a print job that the apparatus 100 processes.

The apparatus 100 may be any type of device that reproduces an image onto the print media 110. In one example, the apparatus 100 may be an inkjet printing device, laser printing device, a toner based printing device, a solid ink printing device, a dye-sublimation printing device, among others. Although the present printing apparatus 100 is describe herein as an inkjet printing device, any type of printing apparatus may be used in connection with the described systems, devices, and methods described herein. Consequently, an inkjet printing apparatus 100 as described in connection with the present specification is meant to be understood as an example and is not meant to be limiting.

What has been described and illustrated herein are examples of the disclosure along with some variations. The terms, descriptions and figures used herein are set forth by way of illustration only and are not meant as limitations. Many variations are possible within the scope of the disclosure, which is intended to be defined by the following claims—and their equivalents—in which all terms are meant in their broadest reasonable sense unless otherwise indicated.

What is claimed is:

1. A media bin assembly comprising:

a media bin;

an optical sensor, directed toward the media bin, and having a first emitter and a receiver, the receiver of the optical sensor having a filter to screen photons received at the receiver, wherein the receiver of the optical sensor is an ambient light sensor;

a second emitter to emit photons toward the optical sensor; and a controller to:

determine a count of photons from a source other than the first emitter received at the receiver of the optical sensor, the source including the second emitter; and determine presence of a print media on the media bin when the count of photons is within a threshold.

2. The media bin assembly of claim 1, wherein the second emitter is on the media bin.

3. The media bin assembly of claim 1, wherein the second emitter is positioned beneath a surface of the media bin, the surface of the media bin being opposite the optical sensor.

4. The media bin assembly of claim 1, wherein the second emitter is calibrated to emit photons to penetrate the print media and reach the receiver of the optical sensor when the print media is on the media bin.

5. The media bin assembly of claim 4, wherein the print media is a single sheet of the print media having a thickness of 80 grams per square meter.

6. The media bin assembly of claim 1, wherein the second emitter is an infrared emitter.

7. A printing apparatus comprising:

a media bin;

an optical sensor directed toward the media bin, the optical sensor having a first emitter and a receiver;

a second emitter to emit photons toward the optical sensor; and a controller to:

determine a first count of photons received at the receiver, the photons emitted from the first emitter and reflected back toward the receiver;

determine a second count of photons received the receiver, the photons received from the second emitter;

determine a signal-to-noise ratio based on the first count of photons and the second count of photons;

determine whether the signal-to-noise ratio is within a threshold; and in response to a determination that the signal-to-noise ratio is within the threshold, determine that a print media is present in the media bin.

8. The priming apparatus of claim 7, wherein the controller is further to: in response to the signal-to-noise ratio being within the threshold, laterally translate the media bin from a retracted position to an extended position.

9. The printing apparatus of claim 7, wherein the controller is further to: in response to the signal-to-noise ratio not being within the threshold, determine that the print media is not present in the media bin and maintain the media bin in an extended position.

10. The printing apparatus of claim 7, the controller further to:

determine a distance between the optical sensor and a surface facing the optical sensor;

determining whether the distance is within a distance threshold, the distance threshold being based on a predetermined distance between the optical sensor and an opposing surface of the media bin facing the optical sensor; and in response to the distance being within the distance threshold, determine the second count of photons from the second emitter.

11. A method comprising:

activating, by a processor, an emitter on a media bin with a power level, to emit photons;

receiving, at an optical transceiver, photons including photons emitted by the emitter on the media bin and photons emitted from the optical transceiver and reflected back toward the optical transceiver;

filtering, at the optical transceiver, the photons emitted by the optical transceiver;

determining, by the processor, a count of photons received at the optical transceiver for the photons emitted by the emitter;

determining whether the count of photons is within a threshold; and in response to the determination that the count of photons is not within the threshold, adjusting the power level of the emitter until the count of photons is within the threshold to determine a calibrated power level for the emitter.

12. The method of claim 11, the method further comprising:

determining, by the processor, the calibrated power level for the emitter when a print media is present between the emitter and the optical transceiver.

13. The method of claim 11, wherein the threshold is based on a maximum translucency value and a minimum translucency value of a print media when the print media is present on the media bin.

* * * * *